US005600213A

United States Patent [19]

Hiramoto et al.

[11] Patent Number: 5,600,213

[45] Date of Patent: Feb. 4, 1997

[54] CIRCULAR ACCELERATOR, METHOD OF INJECTION OF CHARGED PARTICLES THEREOF, AND APPARATUS FOR INJECTION OF CHARGED PARTICLES THEREOF

[75] Inventors: Kazuo Hiramoto, Hitachioota; Junichi Hirota, Hitachi; Kenji Miyata; Masatsugu Nishi, both of Katsuta, all of Japan

[73] Assignee: Hitachi, Ltd., Tokyo, Japan

[21] Appl. No.: 470,478

[22] Filed: Jun. 6, 1995

Related U.S. Application Data

[63] Continuation of Ser. No. 133,217, Oct. 7, 1993, abandoned, which is a continuation of Ser. No. 733,645, Jul. 22, 1991, abandoned.

[30] Foreign Application Priority Data

Jul. 20, 1990 [JP] Japan ..... 2-190543

[51] Int. Cl.[6] ..... H05H 7/00

[52] U.S. Cl. ..... 315/507; 315/501

[58] Field of Search ..... 315/507, 501; 335/210

[56] References Cited

U.S. PATENT DOCUMENTS

| | | | |
|---|---|---|---|
| 3,546,524 | 12/1970 | Stark | 315/507 |
| 3,757,237 | 9/1973 | Hendry | 315/507 |
| 4,780,682 | 10/1988 | Politzer | 328/233 |
| 4,812,774 | 3/1989 | Tsumaki et al. | 328/235 X |
| 4,988,950 | 1/1991 | Nakayama et al. | 315/507 |
| 5,117,194 | 5/1992 | Nakanishi et al. | 328/235 X |

*Primary Examiner*—Sandra L. O'Shea
*Assistant Examiner*—Matthew J. Esserman
*Attorney, Agent, or Firm*—Antonelli, Terry, Stout & Kraus, LLP

[57] ABSTRACT

The present invention is to provide a method and an apparatus which are able to inject a large amount of charged particles to a circular accelerator. In order to inject a large number of charged particles, the charged particle beams are injected into a region of a vacuum duct other than the region which is defined as having a height equivalent to the height of the injected beam and a width from the injected point in the vacuum duct to the symmetrical point to the injected point with respect to the geometrical center of the vacuum duct.

16 Claims, 11 Drawing Sheets

CIRCULAR ACCELERATOR, METHOD OF INJECTION OF CHARGED PARTICLES THEREOF, AND APPARATUS FOR INJECTION OF CHARGED PARTICLES THEREOF

This application is a continuation application of Ser. No. 08/133,217, filed Oct. 7, 1993, now abandoned, which is a continuation of application Ser. No. 07/733,645, filed Jul. 22, 1991, now abandoned.

BACKGROUND OF THE INVENTION

The present invention is related to a circular accelerator having a round orbit of charged particles (called closed orbit hereinafter), especially the circular accelerator which is able to store a large electric current, a charged particles injection method thereof, and an apparatus for the charged particles injection method thereof.

Currently, a small size circular accelerator is being used for exposure of semiconductor patterns and applications in the medical field, and so on. In the conventional small size circular accelerator, the charged particles are injected by a multi-turn injection method which is disclosed in page 4–13 of the Monthly Physics published in Japan [Accelerator Physics (3)].

In the prior art described above, a range of the charged particles which are injected by an injector (in other words, a passing region of the circulating charged particles) at a cross section, which is vertical to the closed orbit, of a vacuum duct wherein the charged particles circulate (the cross section of the vacuum duct means a vertical cross section to the closed orbit if there is no specified comments thereinafter) has been regulated to a linear region from an outlet of the injector to a position in the vacuum duct corresponding to an opposite side of the outlet of the injector with respect to an interval placing the closed orbit at the geometrical center. Therefore, enlargement of the vacuum duct is necessary for increasing the amount of the injected charged particles and increasing of the electric current. The enlargement of the vacuum duct requires enlarging of various electric magnets for circulation of the charged particles and, hence, a problem of enlarging of the whole body of the circular accelerator.

Further, in the prior art described above, an injecting position and an incline of an orbit of the charged particles which are injected from the outlet of the injector into the vacuum duct are necessitated to coincide with the position and the incline of the closed orbit which is set at the outlet of the injector to the circular accelerator. But, the coincidence is difficult because the actual closed orbit of the circular accelerator which is installed differs from the design thereof, and consequently it is impossible to obtain the desired electric current. Accordingly, problems which make the increase of the electric current difficult and, further, a problem that a complex adjustment was necessary for increasing the electric current to the aimed value existed.

SUMMARY OF THE INVENTION

The first object of the present invention is to provide a circular accelerator which is able to inject a large amount of charged particles without requiring enlarging of apparatus such as a vacuum duct etc.

The second object of the present invention is to provide a circular accelerator which is able to inject a large amount of charged particles without complex control.

The first object of the present invention is achieved by providing means for enlarging of a passing region of the charged particles at the cross section of the vacuum duct when the charged particles are injected, As for means to enlarge the passing area of the charged particles, there are following methods, The first one is providing a means to change closed orbit of each of the charged particles, The second one is a means to place at least a central closed orbit of the charged particles at completion of the injection at an opposite side to the outlet of the injection side with respect to the geometrical central closed orbit of the vacuum duct at least the place where the outlet of the injector is installed, The third one is a means for shifting the closed orbit of the charged particles in both the horizontal and vertical directions.

The second object of the present invention is achieved by providing means for changing positions of the closed orbits of the charged particles when the charged particles are injected.

Before explanation on the operation of each of the means described above, the circular accelerator which is the target of the present invention is explained hereinafter.

FIG. 1 is a schematic illustration of a circular accelerator related to an embodiment of the present invention.

The circular accelerator is composed of a pre-accelerator 30, an injector 1 which injects the charged particles 9 from the pre-accelerator 30 into a vacuum duct 5 through a beam transferring or transport system 32, high frequency accelerating cavity 15 which adds energy to the injected charged particles, a bending magnet 13 which deflects orbits of the charged particles 9 for circulation of the charged particles 9, a quadrupole magnet 14 for focussing the charged particles so as not to diverge the charged particles 9, an apparatus $\mathbf{17}_0$ for shifting a closed orbit which is a feature of the present invention, and a controller 16 which regulates members described above.

As described above, a circular orbit of each charged particle is called a closed orbit. And, the closed orbit which is established by the bending magnet 13 and the quadrupole magnet 14 of the charged particles during circulation of the charged particles is called a central closed orbit in order to be distinguished from other closed orbits of the charged particles. Generally, the charged particle circulates with oscillation around the closed orbit as shown by a broken line in FIG. 1. The oscillation is called betatron oscillation. Further, taking a rectangular coordinates x, s as shown in FIG. 1, s direction shows the circulating direction of the charged particles 9 and xs plane shows a plane including the closed orbits of the charged particles. And, y direction is defined as a vertical axis to the xs plane.

Next, operation of each of the means to achieve the first object is explained with illustration of working of the circular accelerator.

The number of the charged particles which can be injected, and therewith the quantity of electric current depends upon the cross section of the vacuum duct through which the charged particles pass. When the charged particles are injected one-dimensionally, e.g., in the horizontal direction as in prior art, the cross section of the beam is proportional to the length of passing region in a direction that the betatron oscillation is generated, in other words, the number of charged particles which can be injected is proportional to a square of maximum amplitude of the betatron oscillation. Therefore, the present invention enlarges the passing region without increasing the duct size. The charged particles are injected into the vacuum duct from the outlet of the injector continuously during a pre-determined time. The betatron oscillations are generated at the time of injection and the maximum amplitude of the oscillations is a distance from the outlet of the injector to the central closed orbit at the time of injection. In the prior art, the charged particles were injected with gradual changing of location of the central closed orbit near the outlet of the injector from the outlet A in FIG. 2 to the geometrical center of the orbit O. Consequently, in the prior art, the amplitudes of the betatron oscillations were increased gradually as moving the central closed orbit. Therefore, the betatron oscillations of the charged particles are enlarged from small value at the initiation of the injection to the maximum value at the time just before the completion of the injection. Further, as the number of the betatron oscillations per one revolution is not an integer, the charged particle passes various positions at the cross section of the vacuum duct. As a result, the passing region of the charged particle becomes twice the distance l, which is the maximum amplitude of the betatron oscillations, from the outlet A to the geometrical center of the orbit O, namely, the line AC shown in FIG. 2.

The first and the second means provide means which are able to inject the charged particles into the linear region BC located at an opposite side to the outlet and into which region the prior art has been unable to inject charged particles.

First, the first means is explained. The operation of the first means is as follows. For instance, as a means to change the closed orbit of each of the charged particles, a case to accelerate or to decelerate the charged particle is assumed. The injected charged particle has a tendency to draw the more outside orbit when the charged particle has the higher energy, and on the contrary, a tendency to draw the more inside orbit, when the charged particle has the lower energy due to a centripetal force of a bending magnet 5. Accordingly, the closed orbit of the charged particle can be altered by acceleration or deceleration of the charged particle. Consequently, the charged particle is able to pass within the linear region BC in FIG. 2 by the change of the closed orbit by acceleration or deceleration of the injected charged particles.

As described above, by making the charged particle accelerate or decelerate so as to pass close to a wall of the vacuum duct, in other words, by enlarging the energy spread of the charged particle so as to correspond the width of the vacuum duct, the charged particle can be injected into the opposite region to the outlet of the injector where the injection has been impossible. As a result, an increase enlarging of the electric current becomes possible.

Especially, when the charged particles are accelerated or decelerated irregularly, the distribution of the charged particles in the cross section of the vacuum duct becomes uniform. Hence, more charged particles are able to be injected. And, the same positive effect can be obtained by enlargement of the amplitude of the betatron oscillation.

Next, the effect of the second means is explained. The passing region in the cross section of the vacuum duct in the prior art was from the outlet A of the charged particle till the position C which was the opposite side to the outlet with respect to the geometrical center of the duct. Therefore, by shifting of the closed orbit of the charged particles at least to the opposite side to the outlet at the position where the outlet is located, the passing region can be enlarged as much. The central closed orbit of the charged particles may be changed gradually depending on the number of the injected charged particles by the prior art, or by the first means described above. Further, the central orbit of the charged particles may be shifted not only at the position where the outlet is located, but also at each position along the whole circulation orbit.

Next, the effect of the third means to achieve the first object is explained. As the passing region of the charged particles can be enlarged by scanning two-dimensionally of the closed orbit of the charged particles at the cross section of the vacuum duct, injected amount of charged particles can be enlarged more in comparison with the one-dimensional injector of the prior art. The number of charged particles injected is proportional to the square of the length of the passing region in the direction where the betatron oscillation is generated as described above. Therefore, by the means of two-dimensional scanning, for instance, if betatron oscillations are generated in x, y direction of the x–y plane, the electric current at injection is proportional to the product of the squares of the lengths of the passing region in the directions where each of the betatron oscillations are generated. While, when the betatron oscillation is generated only in one direction, the electric current at injection is the square of the length of the passing region in the direction.

Finally, the means to achieve the second object of the present invention is explained. In the prior art, when the position and inclination of the outlet are actually shifted from their designs, the amplitudes of betatron oscillations of the injected charged particles become large. When the charged particles come back to the position of the injector again after a circulation, even though their closed orbits are is moved toward inside, the number of the charged particles which collide with the injector is increased as much as the amplitude of the betatron oscillation is increased. And, when shifting the closed orbit slowly, the number of the charged particles which collide with the injector increases as much and whole number of the injected charged particles is not increased. Further, even though the time after the closed orbit is shifted to the position of the geometrical center of the duct is prolonged, most of the charged particles which are injected during the prolonged time collide with the injector and the number of the charged particles which are able to be stored is not increased finally. On the other hand, by the present invention, acceleration and deceleration of the charged particles enlarge the passing region of the charged particles as explained in the description of the first means even though the discrepancy of the position and incline of the outlet of the injector from its design enlarges the amplitude of the betatron oscillation, consequently, the number of the charged particles which collide with the injector decreases as much, and the number of the charged particles which pass the passable region increases by prolonging of the injection time. Therefore, although there are discrepancies or errors somewhat in the position and incline of the outlet of the injector, the effects become less. Accordingly, the charged particles can be injected easily without complicated adjustment of the outlet of the injector.

DETAILED DESCRIPTION OF THE PREFERRED EMBODIMENTS

The embodiment of the present invention are explained with using the drawings hereinafter.

Figure 1:
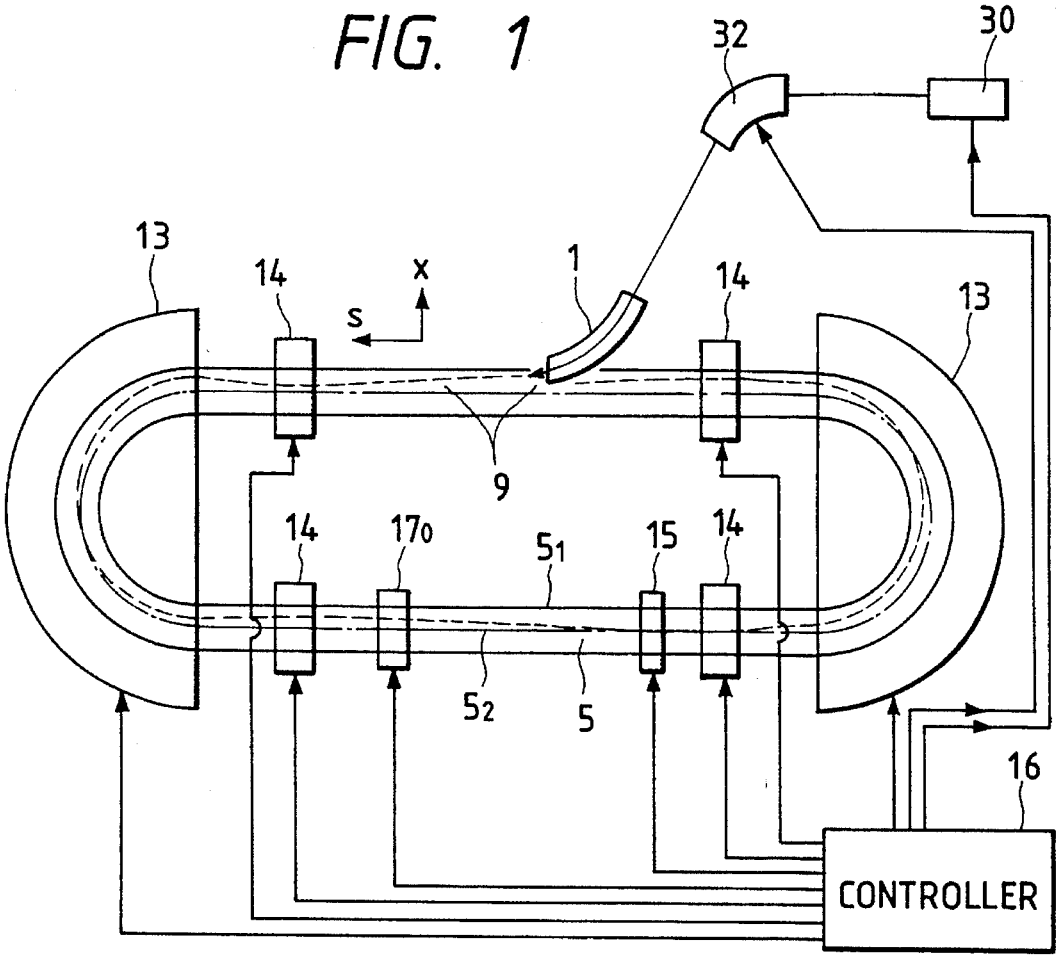
FIG. 1 is a schematic illustration of the composition of the circular accelerator of the first embodiment of the present invention.

The embodiment to achieve the first object and the second object of the present invention is illustrated in FIG. 1. The embodiment is based on the first means to achieve the first object. FIG. 1 illustrates the configuration of magnets in a circular accelerator which injects, accelerates and stores electrons as the charged particles. The numeral 1 is an injector of the electron beam (simply called beam hereinafter), 13 is a bending magnet, 14 is a quadrupole magnet, and 15 is a high frequency acceleration cavity. And 16 is a power source and control unit for the apparatus of 13, 14 and 15.

The beam 9 which is injected by the injector 1 circulates along the closed orbit $\mathbf{5}_2$ whose center coincides with the center of the vacuum duct (called geometrical central closed orbit of the vacuum duct hereinafter) with betatron oscillations, and the betatron ocillations are kept stable by the quadrupole electric magnets 14 and the beam is deflected by the bending magnet 13 so as to be able to circulate.

After completion of the injection, the beam 9 is accelerated from low energy to high energy by receiving energy from the high frequency acceleration cavity 15 which is controlled harmonically with strength of the magnetic field of the bending magnet 13 and the quadrupole magnet 14. The control is called the synchrotron acceleration control. After reaching the desired energy level, the beam 9 is circulated and stored.

Next, the operation of the injection which is one of the features of the present invention is explained in detail.

Figure 2:
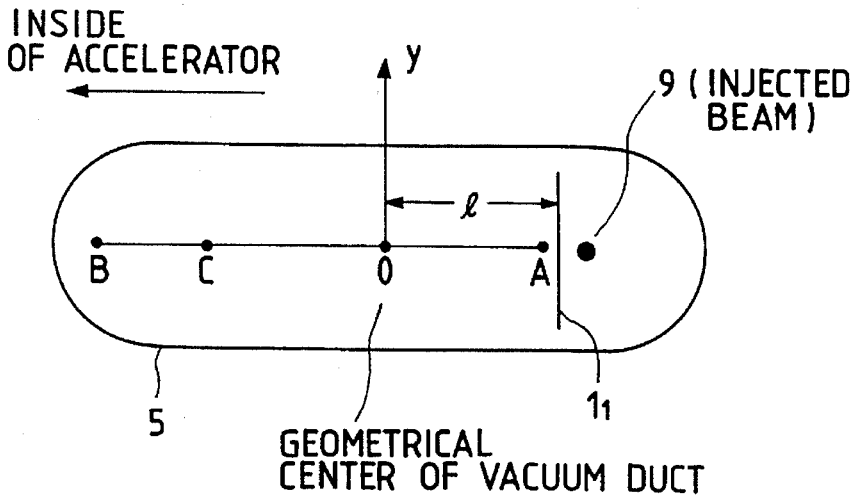
FIG. 2 is a schematic illustration showing the passing region which is enlarged by the first or the second means of the present invention.

In the present embodiment, the central closed orbit is so settled as to coincide closely with the geometrical central closed orbit of the vacuum duct 5 at the initiation of the injection. In the state, the beam 9 is injected from the injector 1. The injected beam 9 is regulated by the quadrupole electric magnet 14 and, later, comes to depict a semicircle orbit by receiving of centripetal force from the bending magnet 13, and finally comes to adopt a circular orbit. The beam 9 having the circular orbit at the moment performs betatron oscillation of which amplitude corresponds to the distance from the outlet of the injector to the central closed orbit as described above. Thus, the beam 9 is injected continuously during a predetermined time. As the beam 9 is injected as an agglomerated state having a width as shown in FIG. 2, the amplitude of the betatron oscillation has a width corresponding to the width of the agglomeration. The beam 9 circulating with betatron oscillation is accelerated or decelerated in the direction of the circulation by receiving energy from the closed orbit shifting apparatus $\mathbf{17}_0$. The deflecting radius of the accelerated beam by the bending magnet 13 becomes large and the closed orbit moves toward outside in FIG. 1, that is the injector side in FIG. 2, and the closed orbit of the decelerated beam moves toward inside in FIG. 1, that is the opposite side to the injector in FIG. 2. Therefore, the closed orbit of the beam is able to be changed by acceleration and deceleration of the beam. The closed orbit of the beam moves in a plane (in a horizontal plane) including s and x axes in FIG. 1, hence, the beam comes to be able to pass the linear region BC.

As described above, acceleration and deceleration of the beam enlarge energy dispersion of the electron, that is the charged particle, and make it possible to inject the beam to the opposite side region of the outlet of the injector where the prior art is unable to inject the charged particles. Accordingly, the value of beam current can be enlarged. Especially, irregular acceleration and deceleration causes a uniform distribution of the beam at each passing regions in the cross section of the vacuum duct. In other words, as the beam can be passed uniformly, the charged particles, electrons in the present embodiment, can be injected as much. In the present embodiment, some portion of the beam are lost naturally by the collision with the injector 1 which is located at the opposite side to the linear region BC, but increment of the number of the electrons as a whole can be achieved by slight extension of the continuous injecting time. The reason is explained by taking a case of understandable irregular acceleration and deceleration for an example. Irregular acceleration and deceleration makes it possible to enable the beam pass through uniformly by slight extension of the injecting time. As the result, the electrons to be lost are the only electrons which pass through the portion where the injector 1 is located, and accordingly, the larger number of the electrons in proportion to the length of the other passing regions can be injected finally. Usually, as the ratio of the length of the linear region AB to the linear region AC is about 1.4, it is possible to take almost double value of the electric current in comparison with the prior art.

Next, with the present embodiment, how the second object of the present invention is achieved is explained.

As described above, the passing region in the present embodiment is enlarged by intentional acceleration and deceleration. As described before in the explanation of the first means, acceleration and deceleration, especially irregular acceleration and deceleration of the charged particles expands the passing region of the charged particles even though the amplitude of the betatron oscillations is enlarged by discrepancy or errors of the outlet position and incline of the injector from the design, and the number of the charged particles which collide with the injector increases as much, hence, the number of the charged particles which pass through the passable region is increased by slight extension of injecting time. Consequently, even though there are some discrepancy in outlet position and incline of the injector, the effect becomes small. Accordingly, the charged particle beam can be injected easily without troublesome adjustment of the outlet position of the injector.

Figure 3A:
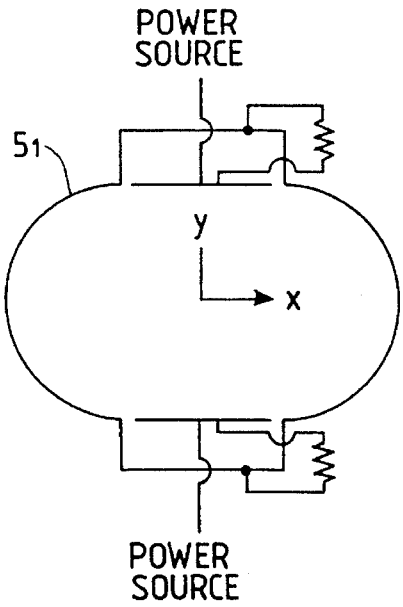
FIGS. 3(*a*) and 3(*b*) are schematic illustrations showing the parallel plate electrodes of the first embodiment of the closed orbit shifting apparatus.
Figure 3B:
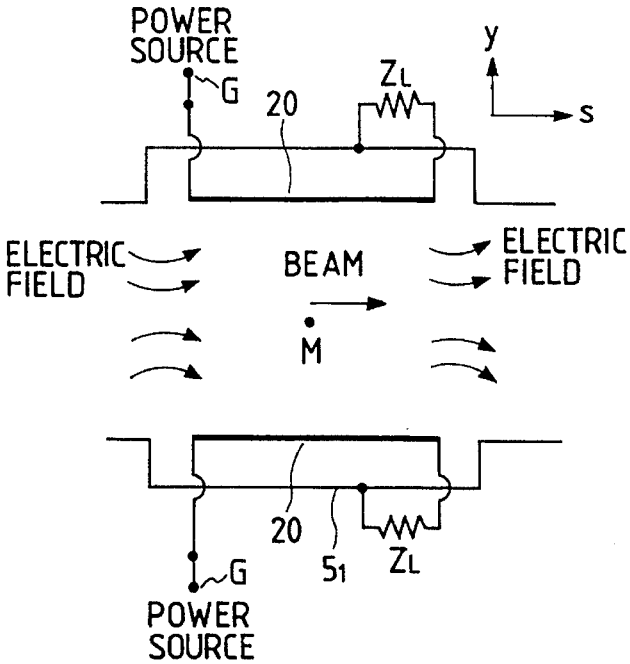
Figure 4:
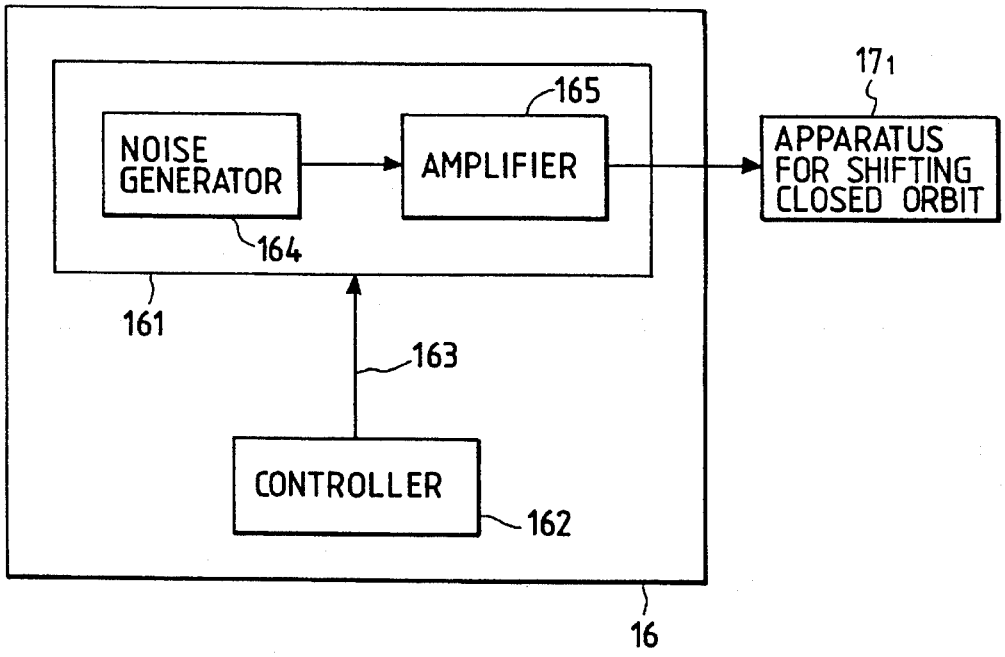
FIG. 4 is a block diagram of the control apparatus of the closed orbit shifting apparatus of the first embodiment.

FIG. 3(*a*) is a schematic illustration showing the parallel flat plate electrodes 20 which are installed at the vacuum duct 5 from the circulating direction, s direction, and FIG. 3(*b*) is a schematic illustration showing the view of the same from x direction. FIG. 4 is a block diagram of the control apparatus 16 of the closed orbit shifting apparatus $\mathbf{17}_0$. The control apparatus 16 is composed of the power source 161 and the control unit 162. Starting and termination of signals from the noise generator 164 in the power source are controlled by the control signal 163 from the control unit 162.

The noise generator 164 generates irregular output signals, which are transmitted to the amplifier as input signals, and subsequently the output signals are charged to each of the parallel flat plate electrodes 20 which are installed in the vacuum duct 5. Therefore, the two of the parallel flat plate electrodes 20 are charged with an equal voltage. As each of the parallel flat plate electrodes 20 is charged with the equal voltage, any electric field is not generated in the region between the two of the parallel flat plate electrodes 20 (near the point M), but an electric field in the beam circulating direction is generated between the electrode 20 and the vacuum duct 5 at the end portion in the beam circulating direction of the parallel flat plate electrode 20. Direction and strength of the generated electric field are regulated irregularly by the noise generator 164. As electron bears negative charge, the beam is decelerated when the direction of the electric field coincides with the circulating direction and accelerated when the direction of the electric field opposes to the circulating direction. The signal to the parallel flat plate electrodes 20 is added from the G in FIG. 3, and the standing wave of the signal is generated on the flat plate electrodes 20. Then by choosing the adequate electrode length and load resistance ZL, the beam is accelerated or decelerated by the electric fields having the same direction at both of the inlet end and the outlet end of the parallel flat plate electrodes 20. The apparatus for adding electric field to the beam is not necessarily the parallel flat plate electrodes but wire electrodes may be usable. The ZL in FIG. 3 is a load resistance.

The irregular altering of strength and polarity of the voltage which is charged to the parallel flat plate electrodes 20 alters the position of the closed orbit of the beam irregularly. The altering quantity of the electric field is suppressed as much as to keep the energy change which is received by the injected beam during one round circulation small, but on the other hand, as much as to keep the necessary quantity for avoiding the collision of the beam against the injector by changing of the position of the closed orbit which is caused by the changing of the energy. When the electric field is charged by the parallel flat plate electrodes 20, the closed orbit of the beam exists at the geometrical center of the vacuum duct which is shown in FIG. 2 at the moment soon after the injection, but by repeating of slight increasing and slight decreasing of the beam energy after the injection, the closed orbit of the beam shifts gradually from the geometrical center of the vacuum duct. In the process, the beam of which closed orbit position shifted largely toward the injector side collides against the injector electrode 11 and is lost, but at the opposite side of the injector, there is a wide space to enable more beams to circulate than the injector side, and by continuous injection of the beams, the beam can be circulated from the proximity to the wall of the vacuum duct $\mathbf{5}_1$ at the opposite side of the injector to the region of the electrode $\mathbf{1}_1$ position of the injector 1. Therefore, the injection of a large amount of charged particles is completed by termination of the charging of the voltage to the parallel flat plate electrodes 20 after a sufficient time elapsed from the initiation of the beam injection. In the case described above, when the energy change per a circulation is large, as the number of the beam having excess amplitude of the betatron oscillations is increased in addition to the increment of the quantity of the closed orbit position changing, the beam loss is increased. Therefore, the energy change of the beam per a circulation is suppressed small as described above.

Figure 5:
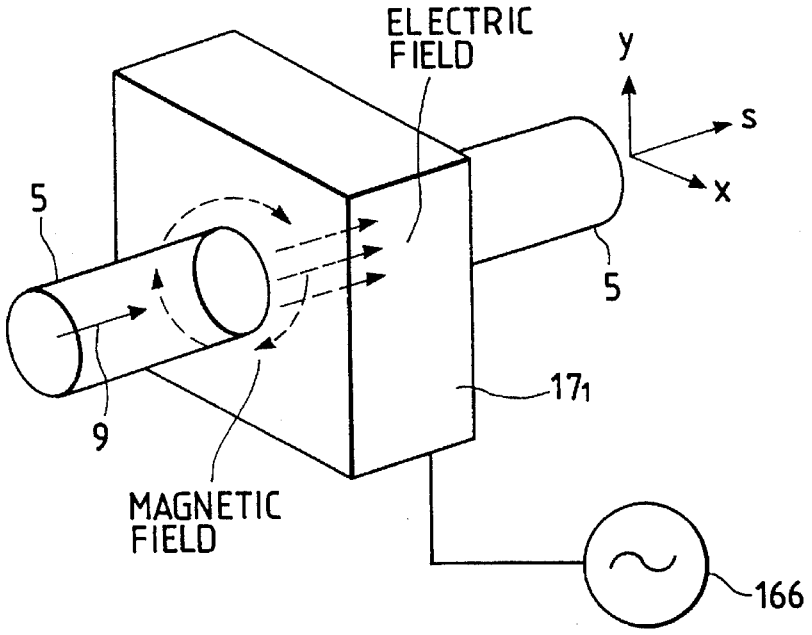
FIG. 5 is a schematic perspective view of the second embodiment of the closed orbit shifting apparatus.

Next, the second embodiment of the closed orbit shifting apparatus $\mathbf{17}_0$ is explained. In the second embodiment, the resonance type cavity $\mathbf{17}_1$ shown in FIG. 5 is used as the closed orbit shifting apparatus $\mathbf{17}_0$ in the same circular accelerator as shown in FIG. 1. The resonance type cavity $\mathbf{17}_1$ in FIG. 5 generates an alternating electric field in the circulating direction and an alternating magnetic field in the xy plane as shown in FIG. 5 by charging of alternating voltage having frequency of $f_c$ by the alternating power source 166 in the control apparatus 16. Therefore, the beam is accelerated or decelerated by the alternating electric field when passing through the resonance type cavity $\mathbf{17}_1$. Especially, when the ratio $f_c/f_r$ of the frequency of the charged electro magnetic field $f_c$ and the circulating frequency of the beam $f_r$ is chosen to be close value to an irrational number, the irregular effect which is shown in the first embodiment is generated. Accordingly, the value of the electric current of the injection can be increased by the same effect as the first embodiment.

Figure 6:
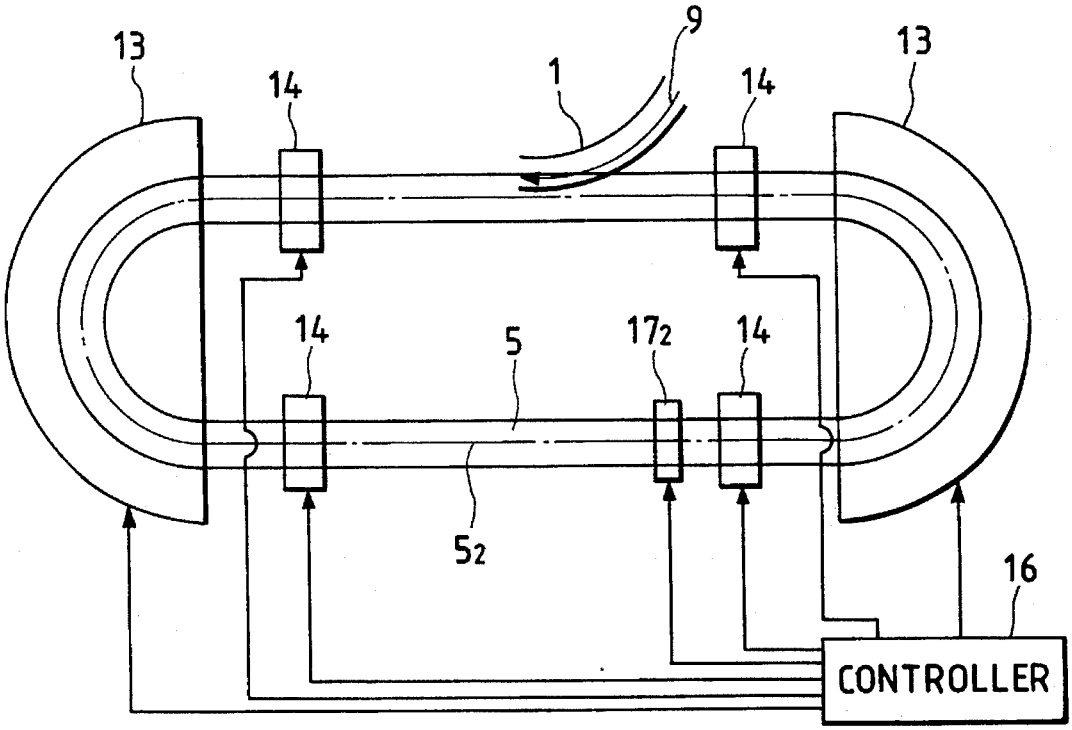
FIG. 6 is a schematic illustration of the composition of the circular accelerator of the third embodiment of the present invention.
Figure 7:
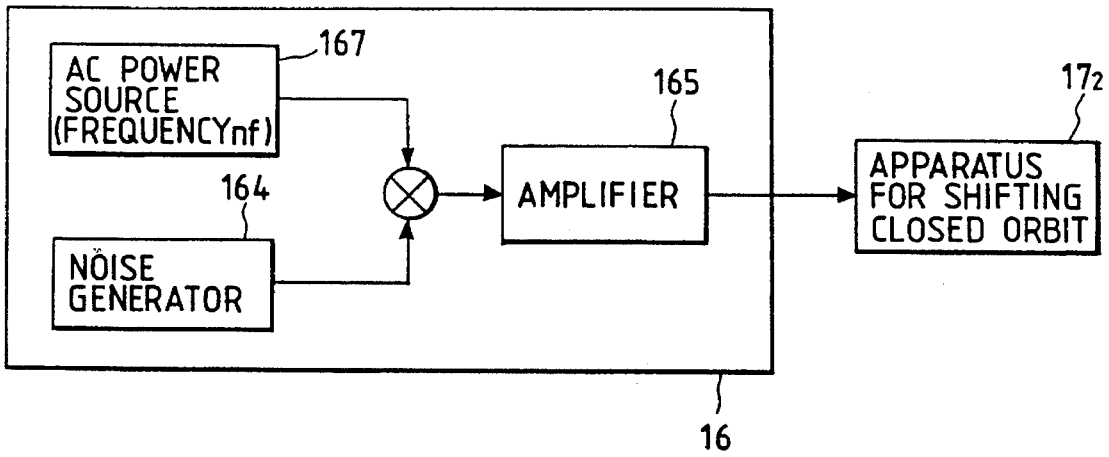
FIG. 7 is a block diagram of the control apparatus of the third embodiment of the closed orbit shifting apparatus.

Further, the third embodiment of the closed orbit shifting apparatus $\mathbf{17}_0$ which accelerates or decelerates is explained. The composition of the accelerator of the present embodiment is shown in FIG. 6. In the present embodiment, the apparatus $\mathbf{17}_2$ has the same structure as that of the high frequency cavity 15 and is used for both the functions of the light frequency cavity and the closed orbit shifting apparatus. The composition shown in the FIG. 6 is different from the composition shown in FIG. 1 only with respect to the position of the closed orbit shifting apparatus $\mathbf{17}_2$, and the other members are same. The closed orbit shifting apparatus $\mathbf{17}_2$ of the present embodiment charges to the beam an electric field which is superimposed with both of the components, a component which varies with frequencies of integer multiple n of the circulating frequency of the beam and a component which varies irregularly. The function of the high frequency acceleration cavity is to make the beam circulate in the constant central closed orbit, or to increase energy of the beam. The block diagram of the control apparatus 16 of the closed orbit shifting apparatus $\mathbf{17}_2$ is shown in FIG. 7. The closed orbit shifting apparatus $17_2$ is charged with voltage signal which is superimposed with both of an alternating voltage having the frequency of nf from the alternating power source 167 and an alternating voltage from the noise generator 164 of which strength varies at random by time. As the circulating frequency of the beam is $f_r$, the beam is accelerated or decelerated with the electric field of which strength varies at random by the closed orbit shifting apparatus $17_2$ at every circulation. Therefore, the circulating region is increased by the shifting of the closed orbit of the beam, and consequently, the value of electric current of the injection can be increased. And, after completion of the injection, the noise generator 164 is stopped, and the closed orbit shifting apparatus $17_2$ stops charging of the voltage of which strength varies at random and charges only the alternating voltage having frequency of $nf_r$ to the beam. Accordingly, the beam can be accelerated after the completion of the injection.

As explained above, the same effects as the embodiments 1 and 2 are obtained by the present embodiment.

In the embodiments described above, the means to achieve the first and second objects by alternating the electric field which is charged in the circulating direction is explained. The following fourth embodiment is the embodiment which achieves the same object by charging the magnetic field in the vertical direction to the xs plane in FIG. 1, that is y direction in FIG. 2. The closed orbit shifting apparatus $17_3$ of the present invention is an electric magnet having the same function as the bending magnet 13, for instance a dipole electric magnet. The beam is affected by a force in the x direction when passing through the electric magnet, and the closed orbit of the beam is shifted depending on the affected force. Therefore, as same as the first embodiment, by changing of the direction and strength of the magnetic field of the electric magnet, the beam shifts its closed orbit to inside of the circulating orbit or outside of the circulating orbit. As a result, the same effect as the effect of the embodiments described above is obtained. Further, irregular changing of the strength of the magnetic field increases the effect more as same as the embodiments described above.

Next, the embodiment of the second means among three means to achieve the injection of the large current which is the first object of the present invention is explained. In the first means, enlarging of the electric current by the shifting of the closed orbit of the each beam or the electron was achieved. In the second embodiment, enlarging of the electric current by the shifting of the central closed orbit of the beam is planned.

Figure 8:
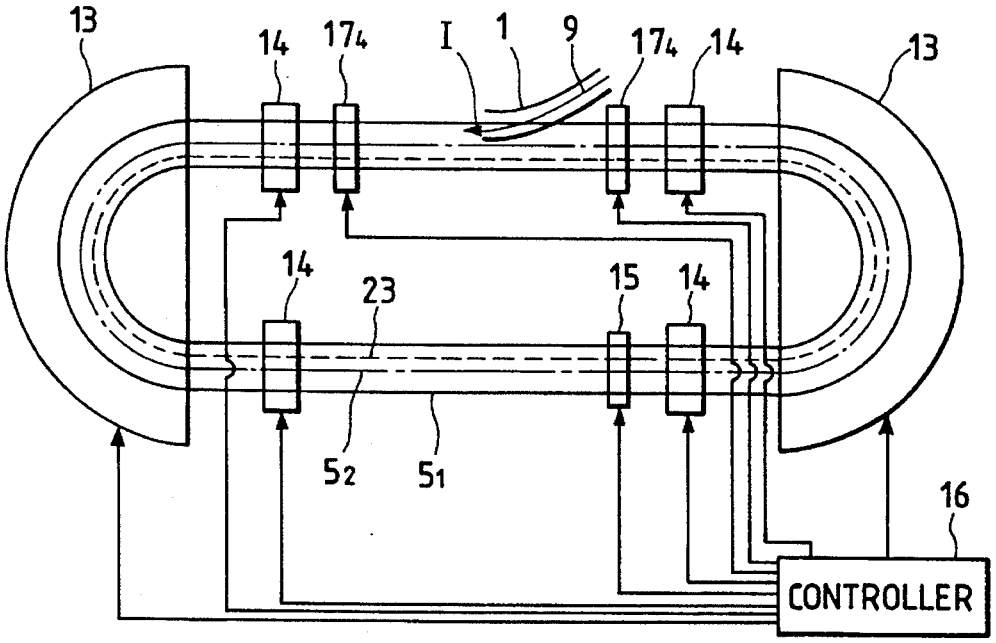
FIG. 8 is a schematic illustration of the composition of the circular accelerator of the fifth embodiment of the present invention.
Figure 9A:
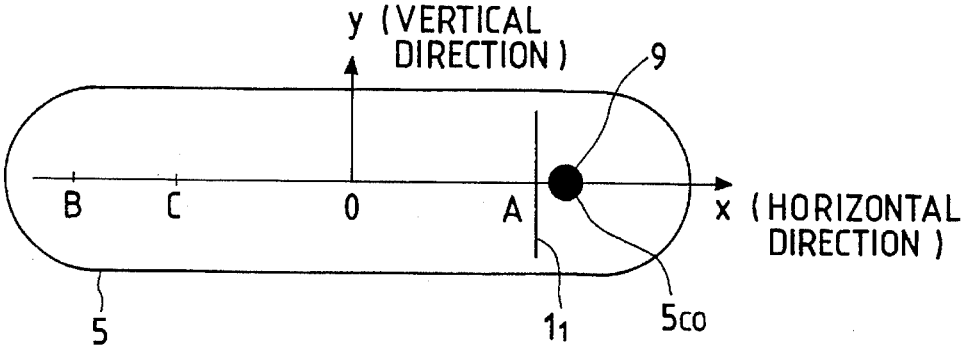
FIGS. 9(*a*)–9(*d*) are drawings showing the injection process of the fifth embodiment.
Figure 9B:
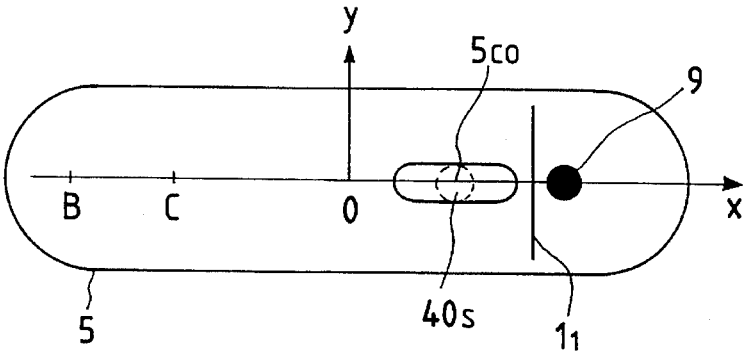
Figure 9C:
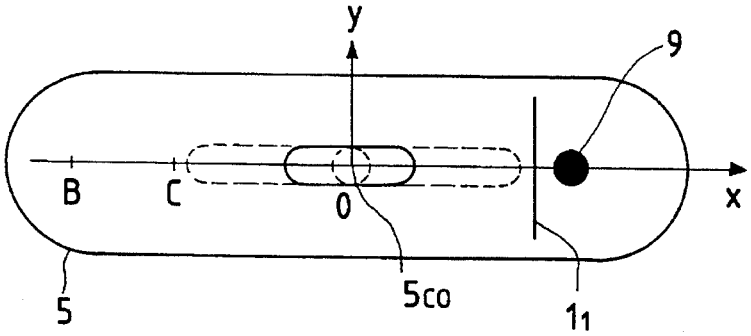
Figure 9D:
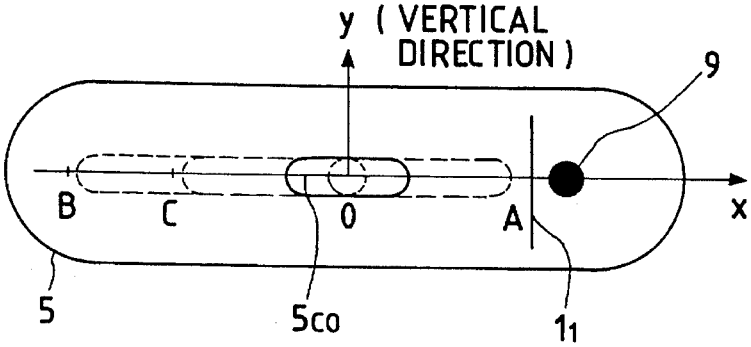

The fifth embodiment which is one of the embodiments of the second means is explained with FIG. 8. The difference of the magnet configuration of the present embodiment from FIG. 1 is in the location of the closed orbit shifting apparatus $17_4$ which are installed at both before and after the injector 1. In the present embodiment, the whole central closed orbit of the beam is shifted before the initiation of the injection from the geometrical central closed orbit of the vacuum duct to the opposite side to the outlet of the injector, that is, to the inside of the circulating orbit 23, and later, only the central closed orbit of the beam between the two closed orbit shifting apparatus $17_4$ is shifted gradually from the outlet of the injection 1 to the inside of the circulating orbit 23. When the inside position of the circulating orbit as described above, that is the central closed orbit of the beam at the completion of the injection, is put at the center of AB in FIG. 2, the passing region of the beam becomes largest. As a result, the passing region of the beam can be enlarged to the linear region A in FIG. 2 and enlarging of the electric current can be achieved.

The detail of the present embodiment is explained hereinafter. The closed orbit shifting apparatus $17_4$ in the present embodiment uses, for instance, an electric magnet which is usually called bump type electric magnet. First, the quantities of excitation of the bending electric magnet 13 and the quadrupole electric magnet 14 are so controlled by the control apparatus 16 as to make the central closed orbit of the beam (energy Ei) after the injection to be shifted to the closed orbit position which is located at inside from the geometrical center of the vacuum duct as is shown as a dotted line 23 in FIG. 8. Next, the quantity of excitation of the bump type electric magnet is so regulated that the position of the closed orbit between the electric magnets $17_4$ is set to pass through the outlet of the injector 1. Later, in accordance with elapsing of the injecting time, the strength of the magnetic field of the electric magnet $17_4$ is gradually decreased by the control apparatus 16, and when the strength of the magnetic field is lowered to zero, the central closed orbit of the beam comes to coincide with the dotted line 23 in FIG. 8 and the injection is completed. The process described above is shown in FIG. 9. FIG. 9 illustrates the cross section of the vacuum duct at the outlet of the injector 1, and the beam 9, the closed orbit of the beam 5co and the spread 40 of the beam by the betatron oscillation of the injected beam at the initiation of the injection, at the middle of the injection (b), (c), and at the completion of the injection (d) respectively. The spread of the injected beam at each of the occasions described above is determined by the amplitude of the betatron oscillations which is determined by the difference of the closed orbit 5co and the outlet position of the injector. Therefore, the spread 40*s* of the injected beam at the initiation of the injection is the spread of the injected beam itself because the central closed orbit 5co of the beam coincides with the outlet position of the injector and the betatron oscillations are hardly generated. Once the beam is injected, the injected beam is shifted toward inside with unchanged spread in accordance with the shifting of the closed orbit 5co of the beam. Later, as the closed orbit 5co of the beam shifts toward inside with elapsing of the time, the spread 40 of the beam is widened gradually, and the spread becomes largest at the completion of the injection as shown in FIG. 9(*d*) and the spread equals to the linear region AB. When the central closed orbit of the beam at the completion of the injection differs from the central closed orbit of the beam at the acceleration and the storing, the quantity of excitation of the bending electric magnet 13 and the quadrupole electric magnet 14 are controlled by the control apparatus 16 and the central closed orbit of the beam is so controlled as to be the desired central closed orbit of the beam, for instance, the geometrical central closed orbit of the vacuum duct. As explained above, in the present embodiment, the beam passing region can be increased by shifting of the central closed orbit of the beam from the geometrical central closed orbit of the vacuum duct to the opposite side of the injector, and hence, the injection of large electric current can be achieved.

In the present embodiment, the first object of the present invention is achieved by the shifting of the closed orbit of the beam at before and after the injector, but the object is achieved similarly with the methods described hereinafter. The first method is to shift the whole central closed orbit of the beam gradually from the outlet of the injector 1 to the inside of the circulating orbit 23. The second method is to shift only the closed orbit of the beam at the outlet of the injector gradually from the outlet of the injector 1 to the inside of the circulating orbit 23 without shifting the whole of the central closed orbit of the beam. As the central closed orbit of the beam can be shifted with the deflecting electric magnet 13 and the quadrupole electric magnet 14 by the first method, the closed orbit shifting apparatus $17_4$ in FIG. 8 becomes unnecessary. The composition of the apparatus for the second method is the same as shown in FIG. 8.

Further, in the fifth embodiment which is shown in FIG. 8, the shifting of the whole central closed orbit of the beam is performed by the deflecting electric magnet 13 and the quadrupole electric magnet 14, but the shifting is able to be performed also by the high frequency acceleration cavity 15. The embodiment of the case is the sixth embodiment. Put f for the frequency of the high frequency acceleration cavity 15, C for the circumferential length of the central closed orbit at the time, and Δf, ΔC for each quantities of changing, the following .equation is established.

$$\Delta C/C=-\Delta f/f \quad (1)$$

Therefore, the whole central closed orbit of the beam can be shifted by controlling of the frequency of the alternating voltage which is charged from the high frequency acceleration cavity. In the case, the central close orbit of the beam is shifted inside of the accelerator with high frequency and shifted toward outside of the accelerator with low frequency.

Next, the embodiment in which both of the first means and the second means are used concurrently is explained.

Figure 10:
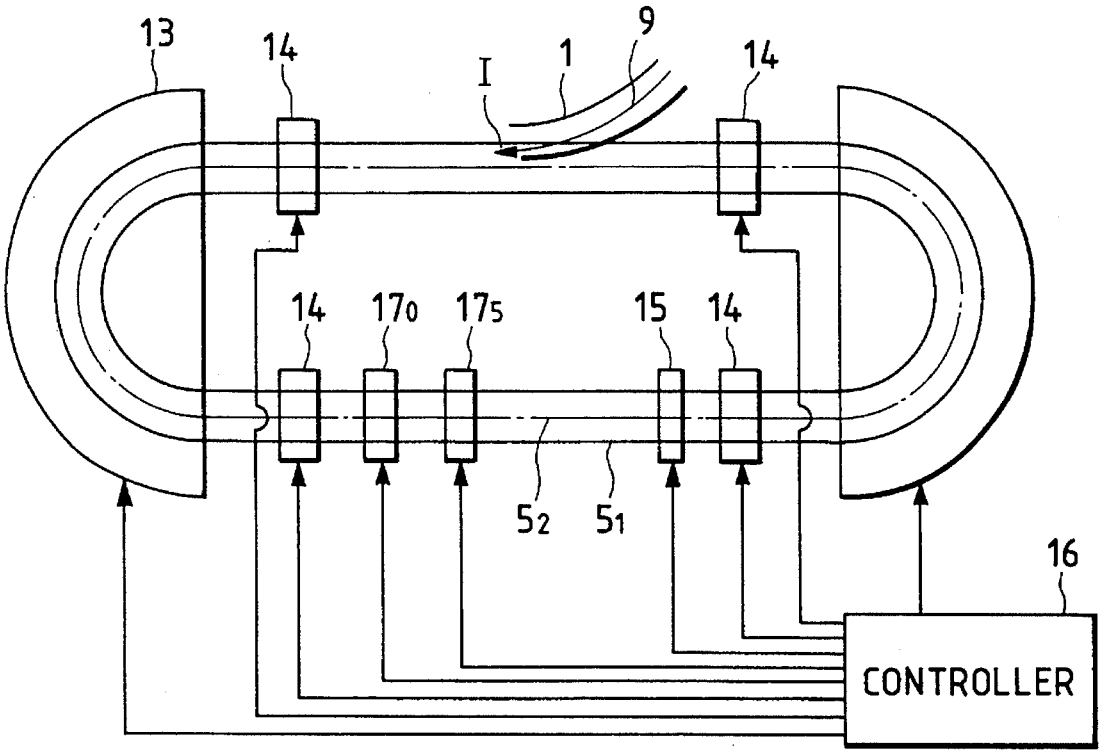
FIG. 10 is a schematic illustration of the composition of the circular accelerator of the seventh embodiment.

The seventh embodiment which is one of the embodiments of the concurrent usage of the two means is illustrated in FIG. 10. In the seventh embodiment, both of the shifting of the position of the closed orbit of the each beam by the electric field in the circulating direction of the beam and the shifting of the position of the central closed orbit of the beam by the magnetic field of the electric magnet are used concurrently. The configuration of the bending electric magnet and the quadrupole electric magnet in the circular accelerator in FIG. 10 is the same as the circular accelerator in FIG. 1. The closed orbit shifting apparatus $17_0$ in FIG. 10 is the same apparatus which shifts the position of the each closed orbit of the beam by the electric field (changes irregularly by time) in the circulating direction of the beam in the first embodiments.

The closed orbit shifting apparatus $17_5$ in FIG. 10 is an electric magnet, and it shifts the closed orbit of the beam. The electric magnet $17_5$ is the same structurally as the closed orbit shifting apparatus $17_3$ which is explained in the fourth embodiment, for instance, it is composed of a dipole electric magnet. The value of electric current of the electric magnet $17_3$ in the present embodiment is decreased gradually from the predetermined initial value in a time which can be converted into tens of circulation of the beam after the initiation of the injection in contrast with the fourth embodiment in which the value of electric current is changed with higher frequency than the circulating frequency of the beam. The initial value of electric current of the electric magnet $17_5$ is so determined that the closed orbit of the beam passes through the proximity of the outlet of the injector for the beam of the circular accelerator (I in FIG. 10). In the state described above, the value of electric current of the electric magnet $17_5$ is decreased gradually. The closed orbit shifts from the initial injected position toward the inner circumferential side of the circular accelerator with the change of the value of electric current of the electric magnet, and the beam is accelerated or decelerated by the electric field which is generated in the process of decreasing of the value of electric current of the electric magnet $17_5$ and is changed at random, As described above, by acceleration and deceleration of the beam, and shifting of the position of the closed orbit in the magnetic field of the electric magnet, the position of the closed orbit of the beam can be shifted from the position of the injection to the inner circumferential side of the accelerator. Accordingly, there is an effect to enable the value of the injected electric current to be increased. Further, in the present embodiment, the shifting of the closed orbit is performed by not only the electric field in the circulating direction of the beam but also the magnetic field of the electric magnet, therefore, the smaller strength of the electric field than the strength of the electric field in the accelerator of the first embodiment in which the increment of the injected electric current is achieved by only the electric field in the circulating direction of the beam is sufficient.

In the seventh embodiment as described above, the timing to start the closed orbit shifting apparatus $17_0$ may be at any time. Although the apparatus is started at the initiation of the injection in the explanation above, for instance, the apparatus is not started at first, and after the value of electric current of the electric magnet $17_5$ is fixed when the closed orbit of the beam coincides with the geometrical central closed orbit of the vacuum duct, the apparatus may be started. Further, in the present embodiment as well as the first embodiment, the electric magnet $17_3$ in the fourth embodiment is used as the closed orbit shifting apparatus $17_5$ and each of the closed orbits of the beam may be shifted by the magnetic field for the achievement of the object. In the case described above, both of the closed orbit apparatus $17_5$ and $17_0$ can be used.

Figure 11:
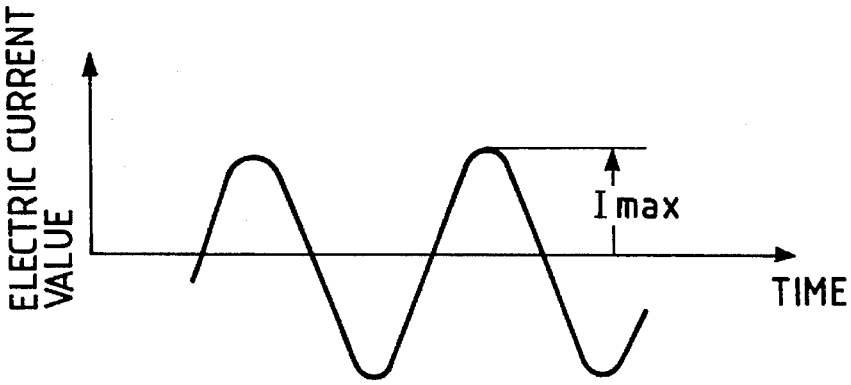
FIG. 11 is a graph showing the change of electric current of the magnet which composes the seventh embodiment of the closed orbit shifting apparatus.

Next, another modified example of the seventh embodiment is explained. The composition of the accelerator of the present embodiment is same as the seventh embodiment in FIG. 10, the electric magnet $17_5$ for shifting of the closed orbit is excited with alternating current (one cycle of the current is the time equivalent to tens circulation of the beam in the accelerator). The change of electric current of the electric magnet $17_5$ for shifting of the closed orbit is shown in FIG. 11. The maximum value of the electric current Imax is so determined that the closed orbit position of the beam with maximum displacement is not outside the injected position of the beam I. In addition to giving the electric current shown in FIG. 11 to the electric magnet $17_5$, the electric field in the circulating direction of the beam is added by the closed orbit shifting apparatus $17_0$ as well as the seventh embodiment. As a result, the circulating region of the beam can be increased, consequently the injected electric current is increased. In the present embodiment, the change of electric current of the electric magnet $17_5$ for closed orbit shifting is sine wave, but triangular wave, sawtooth wave, and their modified wave can be used.

Finally, the third means to achieve the first object of the present invention is explained.

Figure 12:
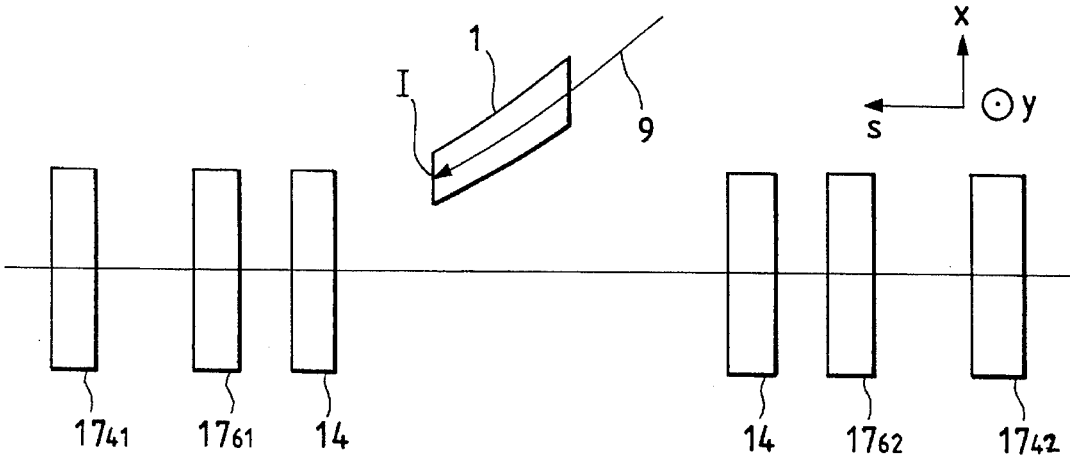
FIG. 12 is a schematic illustration showing the configuration of magnets near the injector of the eighth embodiment of the present invention.
Figure 13:
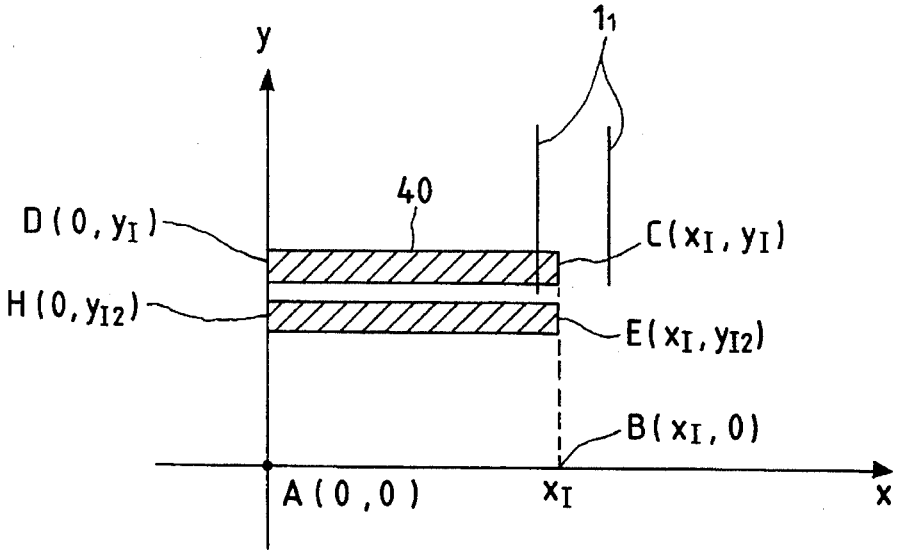
FIG. 13 is a schematic illustration showing the injection process of the eighth embodiment.

The eighth embodiment of the present invention which is one of the embodiments of the third means is explained with FIG. 12. The composition of the apparatus in the eight embodiment is the same as the composition of the fifth embodiment which is shown in FIG. 8 except for the addition of the closed orbit shifting apparatus $17_6$ for shifting the closed orbit in the y direction, that is the vertical direction. The apparatus $17_4$ is used for shifting the closed orbit in the x direction, that is the horizontal direction. FIG. 12 illustrates the configuration of the magnets before and after the injector 1 in an example of the circular accelerator which accelerates electrons having energy of 20 MeV to 500 MeV and stores after injection of the electrons. In addition to the difference in composition of the apparatus described above in FIG. 12, installation of quadrupole electric magnets 14 between the closed orbit shifting apparatus 17 is another different point. The essential function of the closed orbit shifting apparatus 17 is not changed with the installation of the quadrupole electric magnet 14. In the present embodiment, each of the closed orbit shifting apparatus $\mathbf{17}_4$, $\mathbf{17}_6$ is composed of two dipole electric magnets ($\mathbf{17}_{41}$, $\mathbf{17}_{42}$), ($\mathbf{17}_{61}$, $\mathbf{17}_{62}$) respectively. The closed orbit shifting apparatus $\mathbf{17}_4$ generates changing of magnetic field in vertical direction in order to shift the closed orbit horizontally, on the other hand, the closed orbit shifting apparatus $\mathbf{17}_6$ generates changing of magnetic field in horizontal direction in order to shift the closed orbit vertically. The xy cross section of the vacuum duct 5 at the outlet I of the injector 1 in FIG. 12 is illustrated in FIG. 13. When the position of the closed orbit of the beam which is injected from the injector 1 is expressed by xy coordinates, the quantity of the excitement of each dipole electric magnets is so adjusted that the closed orbit passes through the point C ($x_1$, $Y_1$) at initiation of the injection. And each strength of magnetic field of four dipole electric magnets $\mathbf{17}_{41}$, $\mathbf{17}_{42}$, $\mathbf{17}_{61}$, and $\mathbf{17}_{62}$ at initiation of the injection is determined as B40, B50, B60 and B70 (generally speaking B40≠B50, B60≠B70, and not necessarily B40>B50, B60>B70) respectively.

Figure 14:
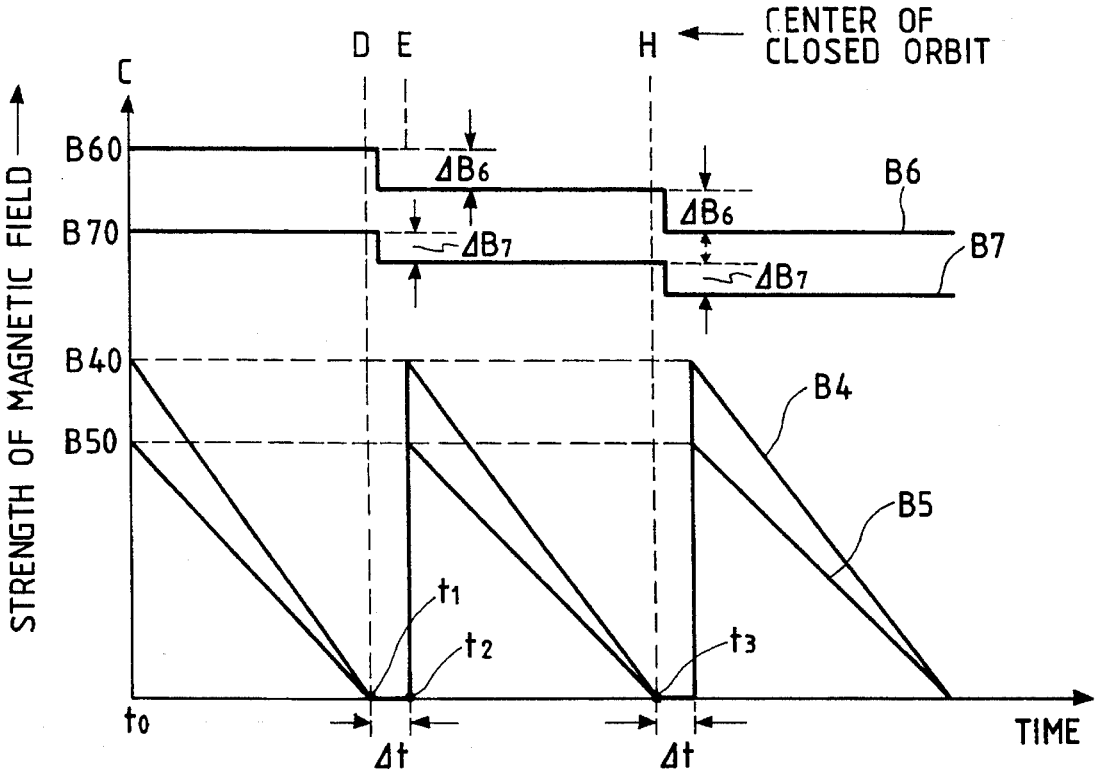
FIG. 14 is an illustration showing the change of the strength of magnetic field of each magnet of the eighth embodiment.

FIG. 14 illustrates changing of strength of the magnetic field at the process of the injection. During the time of the injection started $t_0$ till the time of $t_1$, the strength of magnetic field B6 and B7 of the electric magnets $\mathbf{17}_{61}$ and $\mathbf{17}_{62}$ of the closed orbit shifting apparatus in vertical direction are not changed, and the strength of magnet field B4 and B5 of the electric magnets $\mathbf{17}_{41}$ and $\mathbf{17}_{42}$ of the closed orbit shifting apparatus in horizontal direction are so decreased as to return the horizontal position of the central closed orbit from $x=x_1$ to $x=0$. Time which is required for the decrement is determined as almost 20–50 times of the circulating time of the beam. The area 40 in FIG. 13 indicates the passing region of the beam at the shifting of the closed orbit, and the width in y direction indicates the width of the beam by the betatron oscillations in the y direction. After the closed orbit reaches the position D, the strength of magnetic field B6 and B7 of the electric magnets $\mathbf{17}_{61}$ and $\mathbf{17}_{62}$ are decreased, and make the position of the closed orbit in vertical direction to $y=y_{12}$. Later, the strength of magnetic field B4 and B5 of the electric magnets 4 and 5 respectively at $t=t_2$ are adjusted as B40 and B50 which are the values at the initiation of the injection in order to make the position of the closed orbit in horizontal direction to $x=x_1$. As a result, the position of the closed orbit becomes the position E in FIG. 13. Here, as for the strength of magnetic field of the electric magnets 6 and 7 are so determined that the already injected beam is not lost at the electrode $\mathbf{1}_1$ by the shifting of the closed orbit from the position C to E in FIG. 1. And, the time $_\Delta t$, which is the time for increase of the strength of magnetic field B4 and B5 of the dipole electric magnets $\mathbf{17}_{41}$ and $\mathbf{17}_{42}$ from 0 to B40 and B50 at the initiation of the injection ($_\Delta$≈0 in FIG. 14), is preferable to be short in general.

Next, as the strength of magnetic field B4 and B5 of the dipole electric magnets $\mathbf{17}_{41}$ and $\mathbf{17}_{42}$ respectively are so decreased gradually again as to make the closed orbit x to 0, the position of the closed orbit at the time is the position H in FIG. 13. By repeating of the changing of the magnetic field as described above, the injection can be performed with the shifting the closed orbit so as to cover all inside of the two dimensional region which is surrounded by the four points A, B, C, and D in FIG. 13, and hence, the injection of a large amount if charged particles can be achieved.

Figure 15:
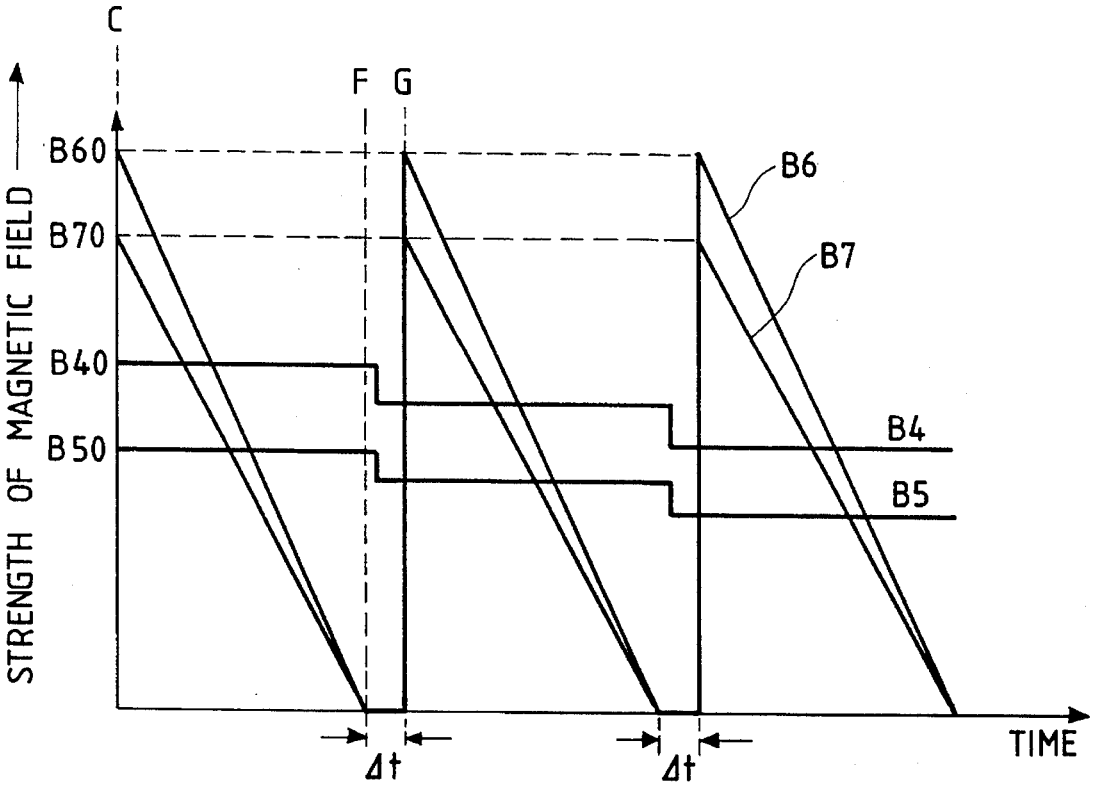
FIG. 15 is an illustration showing the change of the magnetic field of each magnets of the ninth embodiment.
Figure 16:
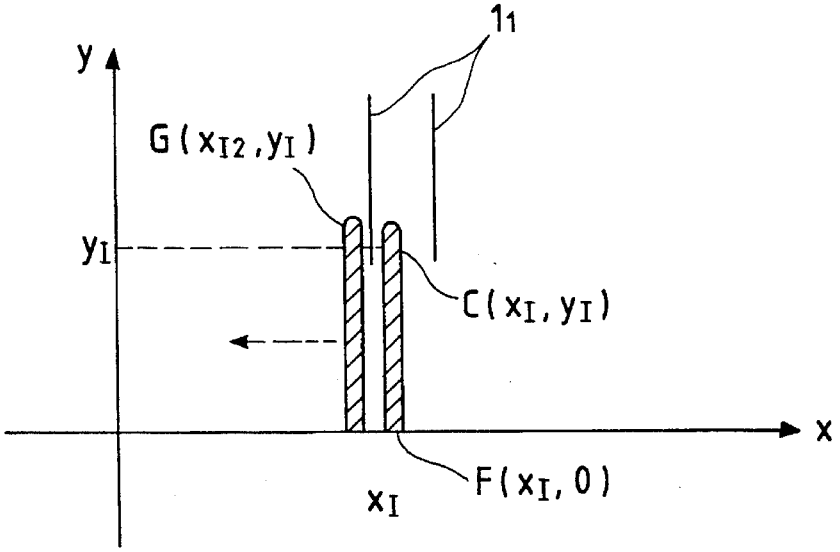
FIG. 16 is a schematic illustration showing the injection process of the ninth embodiment.

Next, the ninth embodiment of the present invention which is to the second embodiment of the third means is explained. In the present embodiment, the accelerator having same composition as shown in FIG. 12 is used, and the closed orbit is placed at the position of the injection (xI, yI) at the initiation of the injection. Later, as shown in FIG. 15, the position in the x direction of the closed orbit is kept at xI as it is, but the strength of magnetic field B6 and B7 of the dipole electric magnets $\mathbf{17}_{61}$ and $\mathbf{17}_{62}$ respectively are so decreased as to return the position in the y direction of the closed orbit to 0. Subsequently, the strength of magnetic field B4 and B5 of the dipole electric magnets $\mathbf{17}_{41}$ and $\mathbf{17}_{42}$ are so decreased that the closed orbit in horizontal direction (x direction) is slightly decreased from xI. The decreasing quantity of magnetic field at the time is so determined that the beam is not lost at the electrode of the injector II after the shifting of the central closed orbit. Later, the position of the closed orbit in the y direction is shifted in the range of y–yI by making the strength of the dipole electric magnets $\mathbf{17}_{61}$ and $\mathbf{17}_{62}$ to B60 and B70 at the initiation of the injection, subsequently the magnets are demagnetized. By the repetitive changing of the strength of magnetic field of the electric magnets, the position of the closed orbit is shifted from the position C to F, G . . . as shown in FIG. 16. That is, the beam is injected with scanning of the closed orbit in the two dimensional region, and large electric current at injection is achieved as well.

Figure 17:
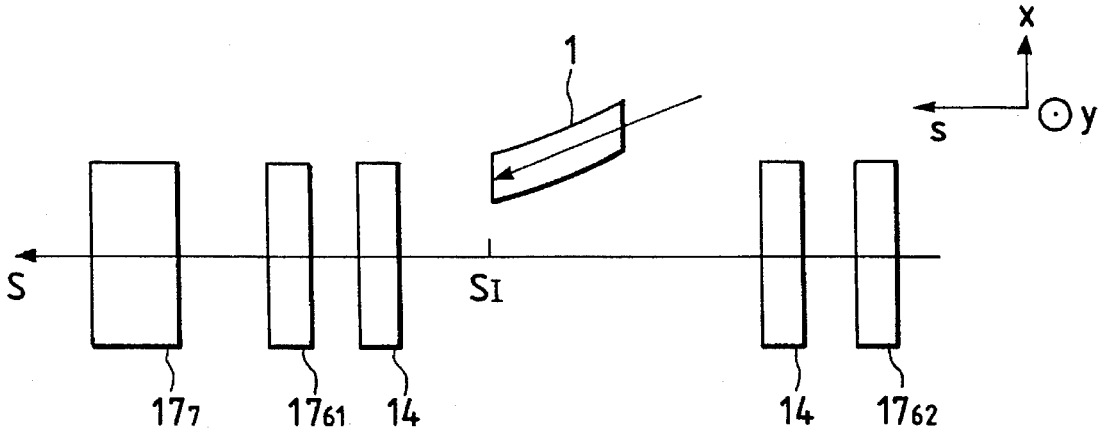
FIG. 17 is a schematic illustration showing the configuration of magnets near the injector of the tenth embodiment of the present invention.

Next, the tenth embodiment of the present invention which is the third embodiment of the third means is explained. FIG. 17 is a schematic cross section of the portion near the injector of the circular accelerator for the present embodiment, and the shifting in vertical direction of the closed orbit is performed by the generation of the magnetic field in horizontal direction with the dipole electric magnet $\mathbf{17}_6$ as well as FIG. 12. But the shifting in horizontal direction is not performed by the dipole electric magnet $\mathbf{17}_4$ but the high frequency charging apparatus $\mathbf{17}_7$. The high frequency accelerating cavity or antenna which are used for increment of beam energy in the conventional circular accelerator can be used, and the parallel plate electrodes which have been described in the second embodiment may be usable. The present embodiment is one of the means to shift the closed orbit among the second means. When using the high frequency accelerating cavity as the high frequency charging apparatus, while the closed orbit is controlled by changing of the frequency in the sixth embodiment, the closed orbit is controlled by the high frequency voltage in the present embodiment. To the high frequency charging apparatus $\mathbf{17}_7$, high frequency having the frequency of the circulating frequency multiplied by integer is charged as well as the case when the beam is accelerated. The position of the injector and the inlet of the beam in the xy plane is same as FIG. 12. The beam is accelerated or decelerated by charging high frequency from the high frequency charging apparatus, and the position of the central closed orbit in horizontal direction of the beam is changed in the process of the injection. The change Δx of the position of the central closed orbit in horizontal direction at the time is given by the equation (2).

$$\Delta x=\eta.\Delta p/p \qquad (2)$$

When, η is a dispersion function and Δp/p is the divergence in momentum of the beam (the dispersion function in vertical direction is usually zero or as small enough as to be regarded as zero, hence, the shifting of the closed orbit in vertical direction by the electric field is negligible). Therefore, the high frequency voltage VRF is so determined as to generate the divergence in momentum Δp/p which makes the change Δx in the equation (2) almost same as the position of the injection xI. The voltage VRF can be obtained by the following equation which solves the stable limit of synchrotron oscillation.

$$\Delta p/p = \sqrt{e}\ VRF \sin\phi_0/\pi\ \alpha\ hE \cdot F\ (1/\sin\phi_0)$$

Where, $\phi_0$ is the acceleration phase, $\alpha$ is a momentum compaction factor, h is a harmonic number, and E is energy of the beam. F is the function expressed by the following equation.

$$F(x) = 2(\sqrt{x^2} - 1 - \cos^{-1}(1/I))$$

Figure 18:
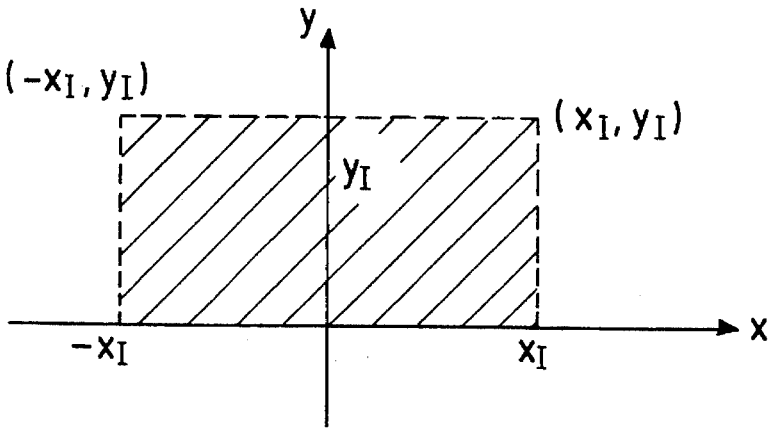
FIG. 18 is an illustration showing the moving region of the central closed orbit of the tenth embodiment.

The magnetic field B60 and B70 are given to the electric magnet $\mathbf{17}_6$ of the closed orbit shifting apparatus in vertical direction in order to place the position of the closed orbit at $Y_1$ at the initiation of the injection, and after the initiation of the injection, the strength of the magnetic field B6 and B7 is decreased gradually and the position of the closed orbit in vertical direction is returned to zero. By performing the scanning which is described in the ninth embodiment in the way as described above, the closed orbit is shifted in the two dimensional region in the xy plane as shown in FIG. 18, and large electric current at injection can be achieved.

When the effect of the large current by the third means is evaluated on the eighth embodiment, if put N for the number of shifting of the closed orbit toward vertical direction, the larger electric current by multiplied N to the of the prior art can be achieved. By adding of the first and the second means, the passing region of the charged particles can be enlarged further, and further enlargement of electric current is achieved.

Figure 19:
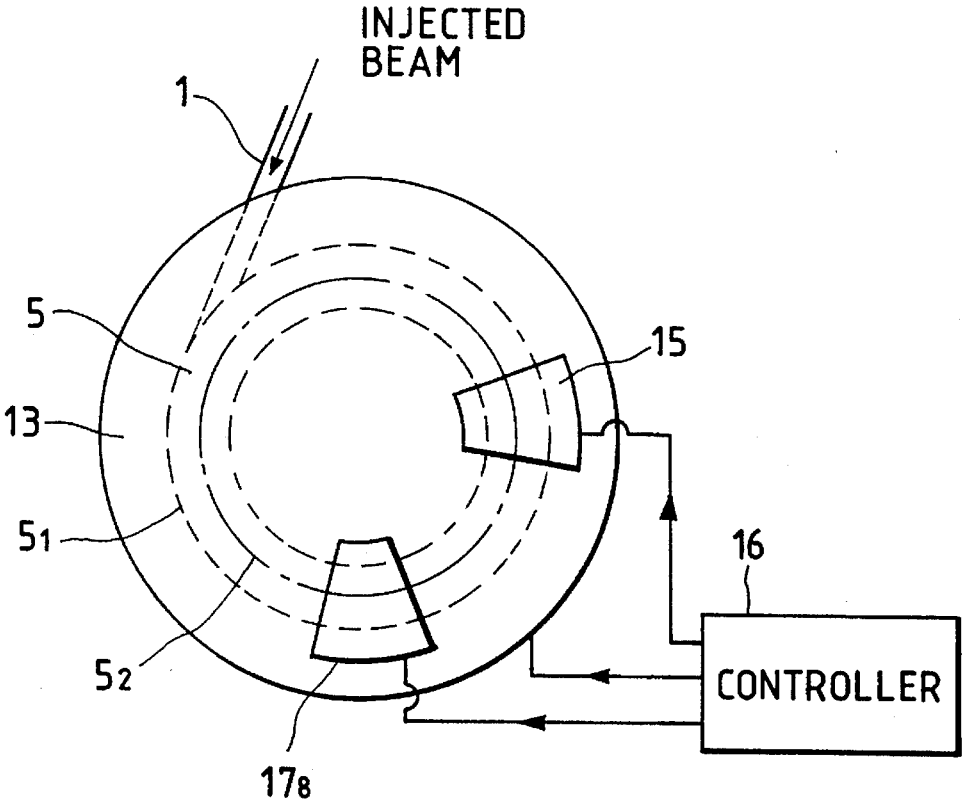
FIG. 19 is a schematic illustration showing one of the embodiments in which the present invention is applied to the circular accelerator which is integrated with a bending magnet of 360°.

All of the embodiments described above are the cases on the circular accelerator whose orbit is the shape of a race track, but the present invention can be applied to the circular accelerator having the orbit whose shape is other than the race track shape. As one of the examples, a case in which the first means to achieve the first object of the present invention is applied to the circular accelerator using a bending electric magnet of deflecting angle 360 degrees as shown in FIG. 19 is explained. The injector 1 is shielded magnetically in order not to be effected by the magnetic field of the bending magnet 13 till the beam from outside reaches to the outside wall $\mathbf{5}_1$ of the vacuum duct 5. The beam which is injected from outside and reaches to the outside wall of the vacuum duct $\mathbf{5}_1$ starts circulation by the magnetic field of the deflecting electric magnet 13. At the closed orbit shifting apparatus $\mathbf{17}_8$, the beam is injected into the circular accelerator by irregular acceleration or deceleration of the beam as well as FIG. 1 and shifting of the closed orbit. After elapsing sufficient time, the acceleration or deceleration at the closed orbit shifting apparatus $\mathbf{17}_8$ is terminated and the injection is completed. Later, the beam circulates stably in the circular accelerator by the high frequency accelerating cavity 15 and bending electric magnet 13. In the present embodiment, the passing region of the beam can be enlarged as well as the first embodiment of the race track shape, and hence enlarging of the electric current can be achieved.

By the present invention, as the passing region of the beam can be enlarged in one dimension or in two dimensions, the circular accelerator which is able to inject large electric current without enlarging of the apparatus such as the vacuum duct etc. can be provided.

Further, as each of the circulating charged particles can be injected by changing of the closed orbit without concerns for position and incline of the injection of the charged particles, the circular accelerator which does not require complex adjustment of the injection related apparatus can be provided.

What is claimed is:

1. A circular accelerator comprising:

means for constituting a center closed orbit;

means for injecting a beam of charged particles into the center closed orbit;

means for accelerating said beam; and additional means, operative only during injection of said beam, for shifting an orbital path of said beam injected into the center closed orbit in a horizontal direction toward a side opposite to the injection side.

2. A circular accelerator as claimed in claim 1, wherein said additional means provides for at least one of acceleration and deceleration of said beam injected into the center closed orbit in a direction parallel with the center closed orbit so as to shift the orbital path of said beam in a substantially vertical direction.

3. A circular accelerator as claimed in claim 1, wherein said additional means shifts the orbital path of said beam by at least one of an electric field and a magnetic field.

4. A circular accelerator as claimed in claim 1, wherein said means for constituting a center closed orbit includes a vacuum duct having a predetermined size and extending in the horizontal direction and a vertical direction so as to have a geometrical center, said additional means including at least one of first means for shifting the orbital path of said beam with respect to a region including a horizontal plane delimited between the geometrical center of the vacuum duct and a point symmetrical to an injection point of the injection side of the charged particles with respect to the geometrical center, and second means for shifting the orbital path of said beam from the horizontal plane.

5. A circular accelerator as claimed in claim 4, wherein the first means shifts the orbital path of said beam into a horizontal region wider than the horizontal region delimited between the injection point and the symmetrical point of the injection point with respect to the geometrical center of the vacuum duct, and the second means shifts the orbital path of said beam from the horizontal plane in a substantially vertical direction into a vertical region larger than a vertical region having a vertical size of a beam of charged particles injected from a pre-stage accelerator.

6. A circular accelerator as claimed in claim 4, wherein said first means includes a high frequency accelerating cavity disposed on a straight section of the vacuum duct between bending magnets.

7. A circular accelerator as claimed in claim 4, wherein said first means includes an electric magnet for determining the orbital path.

8. A circular accelerator as claimed in claim 4, wherein said second means includes an electric magnet for determining the orbital path.

9. A circular accelerator as claimed in claim 1, further comprising means for accelerating said beam after completion of the injection of said beam.

10. A circular accelerator as claimed in claim 1, further comprising control means for operating said additional means only during injection of said beam.

11. A circular accelerator as claimed in claim 1, wherein said means for constituting a center closed orbit include electromagnets, said means for injecting a beam of charged particles includes an injector, and said means for accelerating said beam includes a high frequency accelerating cavity.

12. A method of injection of a beam of charged particles into a circular accelerator having means constituting a center closed orbit, comprising the steps of:

injecting the beam of charged particles into the center closed orbit;

accelerating the beam; and shifting an orbital path of the beam injected in the center closed orbit in a horizontal direction toward a side opposite to the injection side.

13. A method as claimed in claim 12, wherein the step of shifting of the orbital path is effected by means operative only during injection of the beam.

14. A method as claimed in claim 12, wherein the step of injecting the beam into the center closed orbit is effected during a first cycle of an injection period, and the step of shifting an orbital path of the beam is effected during a second cycle of the injection period following the first cycle.

15. A method as claimed in claim 12, wherein the step of injecting the beam into the center closed orbit is effected during at least one injection cycle of an injection period, and the step of shifting the orbital path is effected during at least one shifting cycle of the injection period following the at least one injection cycle.

16. A method as claimed in claim 12, wherein the step of shifting includes at least one of acceleration and deceleration of the beam injected into the center closed orbit in a direction parallel with the center closed orbit so as to shift the orbital path of the beam in a substantially vertical direction.

* * * * *